US008066544B2

(12) United States Patent
Hedeen, Jr.

(10) Patent No.: US 8,066,544 B2
(45) Date of Patent: Nov. 29, 2011

(54) TOY APPARATUS AND ENVIRONMENT THEREFOR

(75) Inventor: Clemens V. Hedeen, Jr., Sturgeon Bay, WI (US)

(73) Assignee: Hedeen International, LLC, Sturgeon Bay, WI (US)

( * ) Notice: Subject to any disclaimer, the term of this patent is extended or adjusted under 35 U.S.C. 154(b) by 0 days.

(21) Appl. No.: 12/756,511

(22) Filed: Apr. 8, 2010

(65) Prior Publication Data

US 2011/0151745 A1 Jun. 23, 2011

Related U.S. Application Data

(60) Provisional application No. 61/288,070, filed on Dec. 18, 2009.

(51) Int. Cl.
*A63H 17/36* (2006.01)
*A63H 17/385* (2006.01)

(52) U.S. Cl. ..... 446/437; 446/454; 446/457

(58) Field of Classification Search ..... 446/175, 446/291, 297, 298, 303, 353, 354, 270, 279, 446/280, 434, 454, 456, 457, 462, 484; 119/15, 119/29

See application file for complete search history.

(56) References Cited

U.S. PATENT DOCUMENTS

| | | | | |
|---|---|---|---|---|
| 112,550 | A | 3/1871 | Clay | |
| 159,928 | A | 2/1875 | Hotchkiss | |
| 470,860 | A | 3/1892 | Caulfield | |
| 1,212,332 | A | 1/1917 | Ensign et al. | |
| 1,574,035 | A | 2/1926 | Holtzman | |
| 2,001,625 | A | 5/1935 | Muller | |
| 2,606,402 | A * | 8/1952 | Fuchs | 446/437 |
| 4,277,909 | A | 7/1981 | Rainwater | |
| 4,673,371 | A * | 6/1987 | Furukawa | 446/175 |
| 4,752,272 | A * | 6/1988 | Karasawa | 446/289 |
| D301,905 | S | 6/1989 | Havelock | |
| D314,593 | S | 2/1991 | Crist et al. | |
| 5,186,122 | A * | 2/1993 | Phillips et al. | 119/474 |
| D358,180 | S | 5/1995 | Gonzales | |
| D373,662 | S | 9/1996 | Box | |
| 5,711,253 | A * | 1/1998 | Phillips et al. | 119/706 |
| 6,039,628 | A * | 3/2000 | Kusmiss et al. | 446/457 |

(Continued)

FOREIGN PATENT DOCUMENTS

DE 373346 4/1923

(Continued)

*Primary Examiner* — Kien Nguyen
(74) *Attorney, Agent, or Firm* — Gifford, Krass, Sprinkle, Anderson & Citkowski, P.C.

(57) ABSTRACT

A toy apparatus may include a frame and a shell that may extend over and around the frame so that the apparatus takes on the appearance of an animal or thing. The frame may support a power source, a motor, drive and support wheel(s), a controller, one or more sensors and/or switches, and an audio emitting device(s). The sensor(s) and/or switches may include one or more of a photo sensor; a pressure, touch or contact sensor; an audio sensor; or any combination of these or similar sensors or switches that are positioned on the "front" and "top" of the frame. The apparatus may also be positioned in and interact with one or more separate or interconnected environments. These environments may include one or more platforms or enclosures, ramp(s), "exercise" wheel(s) and other light or sound emitting devices.

18 Claims, 7 Drawing Sheets

U.S. PATENT DOCUMENTS

| | | | | |
|---|---|---|---|---|
| 6,250,987 | B1 * | 6/2001 | Choi | 446/436 |
| 6,354,842 | B1 * | 3/2002 | Frei | 434/365 |
| 6,964,572 | B2 * | 11/2005 | Cesa | 434/258 |
| D544,929 | S | 6/2007 | Crane et al. | |
| D568,554 | S | 5/2008 | Lamstein | |
| D569,052 | S | 5/2008 | Lamstein | |

FOREIGN PATENT DOCUMENTS

| | | |
|---|---|---|
| DE | 1000270 | 1/1957 |
| DE | 1281328 | 10/1968 |
| FR | 1018655 | 1/1953 |
| GB | 502128 | 12/1937 |

* cited by examiner

TOY APPARATUS AND ENVIRONMENT THEREFOR

CROSS-REFERENCE TO RELATED APPLICATIONS

This non-provisional application claims priority from U.S. provisional application No. 61/288,070, filed Dec. 18, 2009, the disclosure of which is incorporated by reference herein in its entirety.

FIELD OF THE INVENTION

A toy apparatus is disclosed along with an environment in which the toy apparatus may operate and interact. The toy apparatus may include an electric motor, drive and support wheels and control systems. These elements may all be supported on a frame and enclosed by a shell that is shaped to give the toy apparatus an outward appearance of an animal or thing.

BACKGROUND OF THE INVENTION

Clockwork and electro-mechanical toys come in a variety of shapes and sizes. For example, U.S. Pat. No. 112,550 (1871) to Clay disclosed an embodiment for a mechanical Creeping Doll. German patent number DE 1000 270 (1957) taught a mechanical or clockwork mouse toy that operated to "run" into and out of an enclosed circular "mouse house". Also, U.S. Pat. No. 4,277,909 showed a toy mouse or rabbit having a drive assembly that gave the toy a staggered manner of forward motion. More recently, U.S. design Pat. Nos. D569,052 and D568,554 both showed ornamental designs for toy mice.

It would, however, be advantageous to have a toy, particularly one that resembles and mimics a live animal, while also providing an environment into which the toy may be integrated or with which the toy may cooperate.

SUMMARY OF THE INVENTION

A toy apparatus may include a frame and a shell that may extend over and around the frame. The frame may support a power source such as a battery, a motor, drive and support wheel(s), a controller such as an integrated circuit board, one or more sensors and/or switches, and an audio emitting device(s) (on, for example, the circuit board). The sensor(s) and/or switches may include one or more of a photo sensor, a pressure, touch or contact sensor, an audio sensor, or any combination of these or similar sensors or switches that are positioned on the "front" and "top" of the frame. The shell may be placed around or attached to the frame so that the apparatus takes on the outward appearance of an animal (such as a hamster) or thing. This shell may be formed of a plush fabric, a molded plastic or a combination thereof, and may include indicia or designs on its exterior surface. The apparatus may also be positioned in and interact with one or more separate or interconnected environments. These environments may include one or more platforms or enclosures, ramp(s), "exercise" wheel(s) and other light or sound emitting devices.

BRIEF DESCRIPTION OF THE DRAWINGS

Reference will be made infra to the associated drawings in which like reference numerals refer to like parts throughout and wherein.

DETAILED DESCRIPTION OF THE PREFERRED EMBODIMENTS

Figure 1:
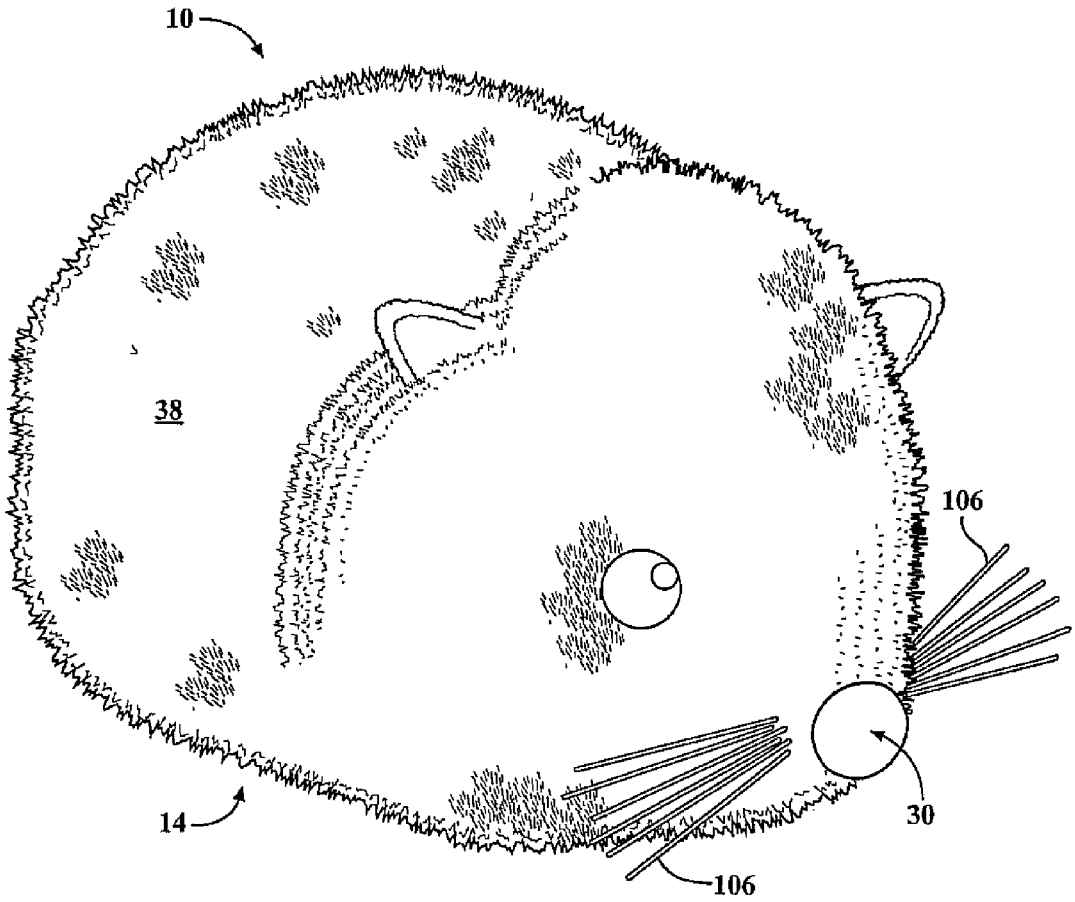
FIG. 1 is a perspective view of an embodiment of the toy apparatus, and specifically an embodiment of a shell (fabric) for the toy apparatus.

Referring now to FIGS. 1-9, a toy apparatus 10 may include a frame 12 and a shell 14 that may extend over and around (e.g., over the top, sides and ends of) the frame 12. The frame 12 may support a power source 16 such as a battery 18, a motor 20, drive 22 and support wheel(s) 24, a controller 26 such as an integrated circuit board 28, one or more sensors and/or switches 30, 32, and an audio emitting device(s) (on, for example, the circuit board 28). The sensor(s) and/or switches 30, 32 may include one or more of a photo sensor; a pressure, touch or contact sensor; an audio sensor; or any combination of these or similar sensors or switches that are positioned on the "front" 34 and "top" 36 of the frame 12. As best shown in FIG. 1, the shell 14 may be placed around or attached to the frame 12 so that the apparatus 10 takes on the outward appearance of an animal (such as a hamster) or thing. This shell 14 may be formed of a plush fabric (FIG. 1), a molded plastic or a combination thereof, and may include indicia or designs on its exterior surface 38. The apparatus 10 may also be positioned in and interact with one or more separate or interconnected environments 200. These environments may include one or more platforms or enclosures 202, ramp(s) 204, "exercise" wheel(s) 206 and other light or sound emitting devices 208.

Referring now to FIGS. 2-7, the frame 12 may be a molded plastic frame having a predetermined configuration suitable for supporting the elements mentioned supra. For example, in the embodiment of FIGS. 2 and 3, the frame 12 may include a pair of opposed sidewalls 40, 42 and have defined on its underside (see FIG. 3) a channel or recesses sufficient to receive and permit movement of tandem drive wheels 22. However, other embodiments for the frame 12, such as those shown in FIGS. 4-7 and others may also be used.

Figure 2:
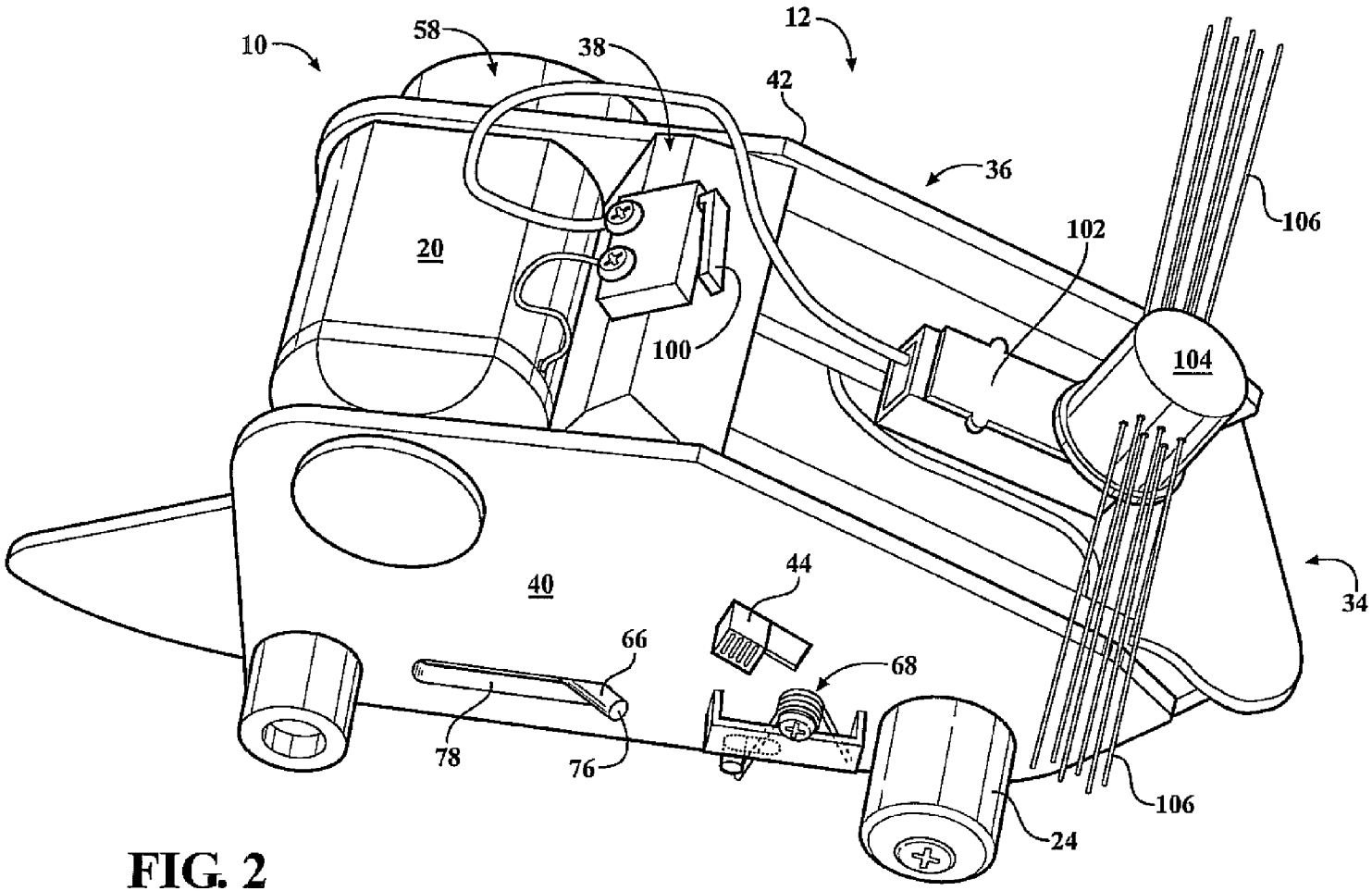
FIG. 2 is a perspective view of the top and a side of a frame for an embodiment of the toy apparatus.
Figure 3:
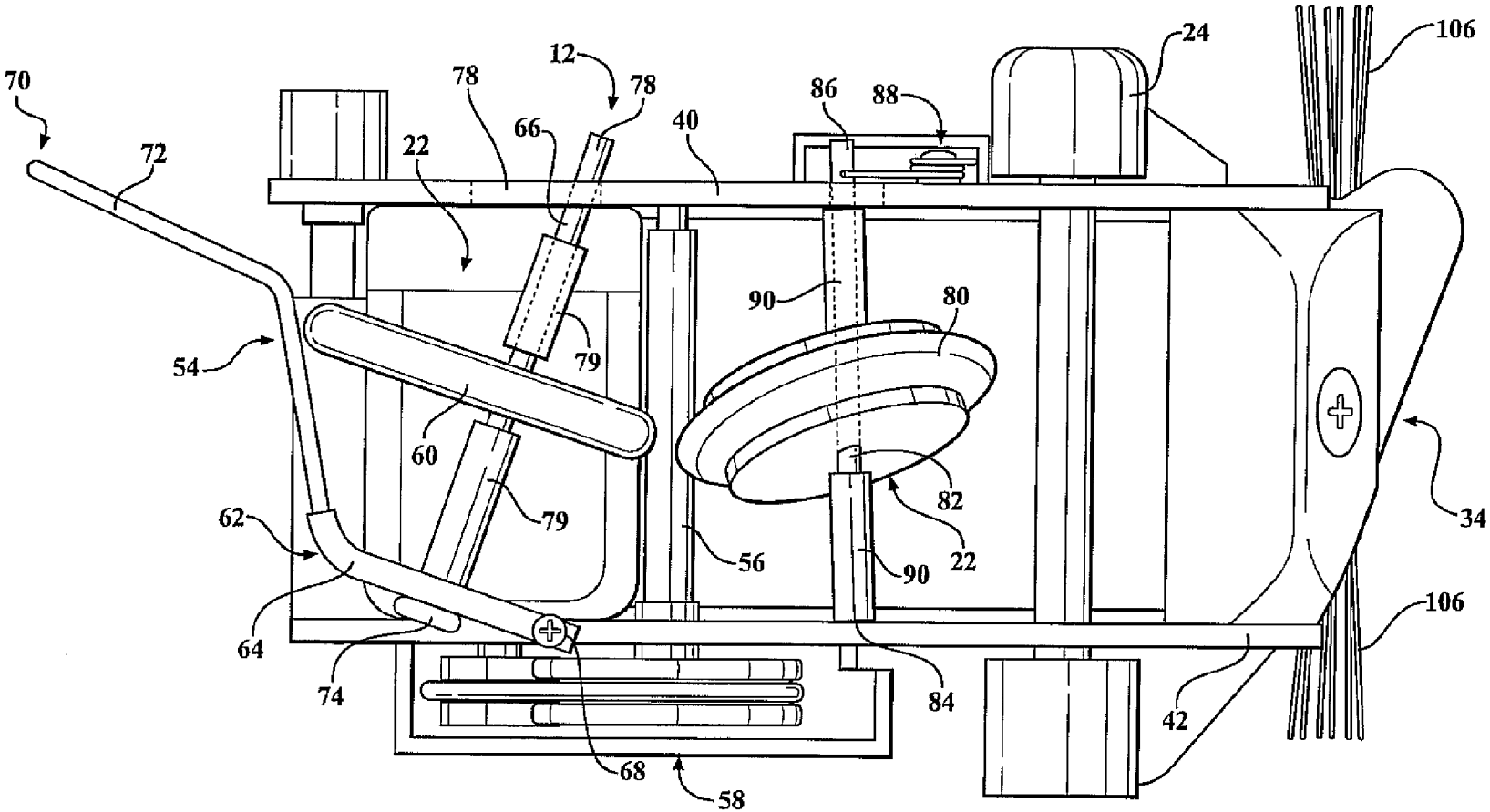
FIG. 3 is a planar view of an underside of the frame of the toy apparatus shown in FIG. 2.
Figure 4:
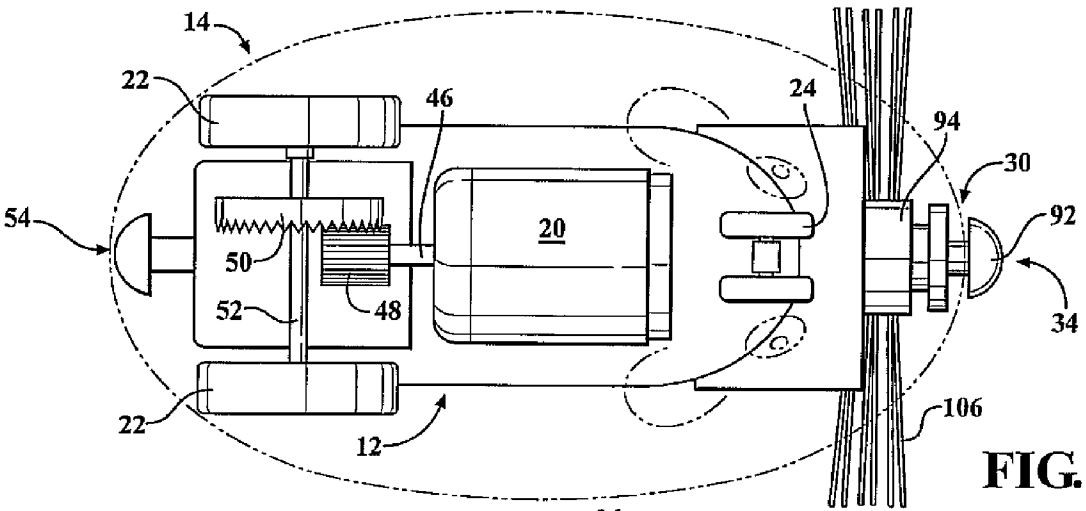
FIG. 4 is a planar top view of another embodiment of the toy apparatus.
Figure 5:
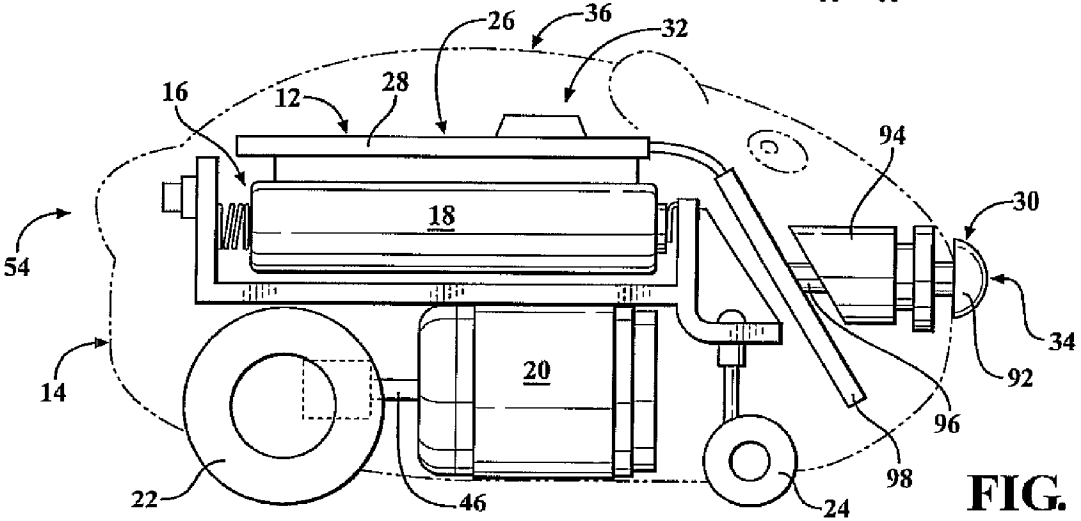
FIG. 5 is a planar side view of the embodiment of the toy apparatus shown in FIG. 4.
Figure 6:
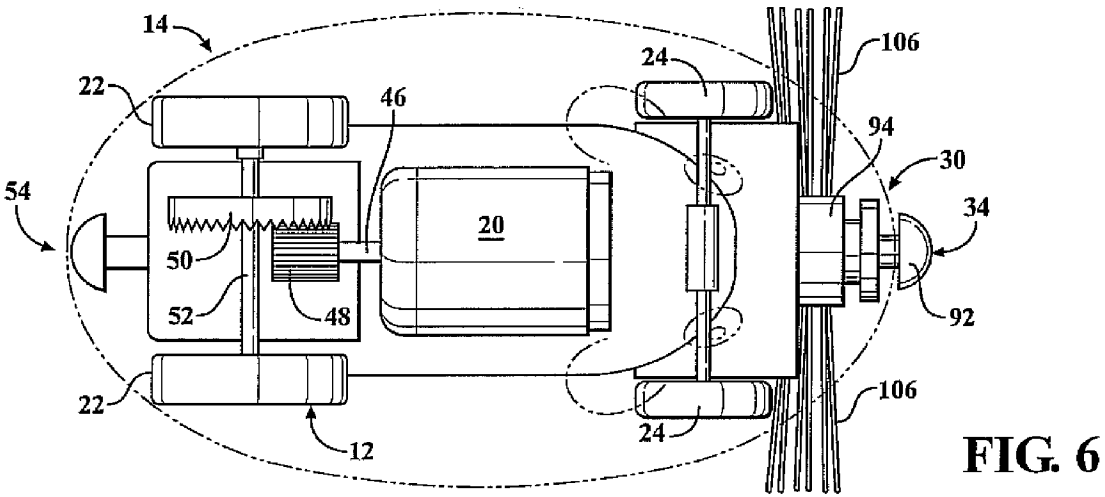
FIG. 6 is a planar top view of still another embodiment of the toy apparatus.
Figure 7:
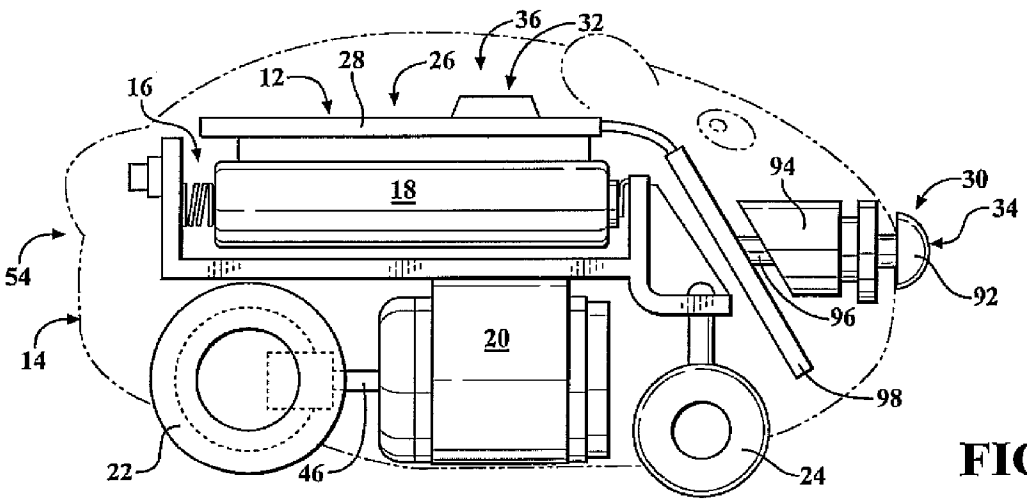
FIG. 7 is a planar side view of the embodiment of the toy apparatus shown in FIG. 6.

Still referring to FIGS. 2-7, the motor 20 may be positioned on the frame 12 and include a DC electric motor in the range of 3 to 24 volts that is powered by one or more AA or AAA batteries 18. As best shown in FIG. 3, the motor 20 may be turned on or off by a power switch 44. As shown in FIGS. 4-7, a drive shaft 46 for the motor 20 may include a normal gear 48 that engages a drive gear 50 affixed to an axle 52 for the drive wheels 22 that may be positioned proximate the "rear" 54 of the frame 12. The one or more support wheels 24 may be positioned forward of the drive wheels 22 and may include caster style support wheels (FIG. 4) or simply wheels that are in axial alignment the drive wheels 22. It will be appreciated, however, that other orientations and arrangements for the wheels 22, 24 may also be used. Moreover, the wheels 22, 24 may be made of plastic, rubber or a combination thereof.

Referring now to FIG. 3, a single, or alternatively two, drive wheel(s) 22 may be arranged inboard of the frame 12 between the sidewalls 40, 42. Where two drive wheels 22 are used, they may be arranged in tandem with one in front of the other. Moreover, the wheel(s) 22 may be offset between 1 and 45 degrees from vertical. This arrangement of the wheel(s) 22 allows for a very unique "wobbling" motion for the toy apparatus 10 that can give it the appearance (when covered by the shell 14) of a rodent walking across a surface.

Still referring to FIG. 3, the drive wheel(s) 22 may be arranged so that they rotatably contact and are driven by a drive bar 56. The drive bar 56 may likewise be mechanically connected to the drive shaft (not shown in FIG. 3) of the motor 20 by a belt and pulley assembly 58 or the like.

Still referring to FIG. 3, a wheel 60 may be mounted to the frame 12 as part of a wheel assembly 62, which may also include a bracket 64 and a wheel axle 66. The bracket 64 may be pivotably mounted at one end 68 to one sidewall 42 of the frame 12. An opposite end 70 of the bracket 64 may include a flange 72 that extends away from the frame 12. The axle 66 may have one end 74 mounted to the bracket 64 and an opposite end 76 that is slidably supported in a slot 78 that may be defined in the opposing sidewall 40. Spacers 79 may be positioned on the axle 66 to assist in maintaining the axle and the wheel 60 in their proper predetermined positions.

Still referring to FIG. 3, the wheel 60 may be offset between 1 and 45 degrees from vertical and the bracket 64 may be biased by springs (not shown) so that the wheel 60 maintains contact with the drive bar 56 during operation. Thus, in operation, an angular offset of the wheel 60, the pivoting of the bracket 64 and the sliding of the axle 66 may cooperate to allow the wheel 60 to travel in a reciprocating path along the length of the drive bar 56 as the bar 56 functions to drive the wheel 60. As mentioned supra, this eccentric travel for the wheel 60 contributes to the toy apparatus 10 taking on a more life-like wobble or walking motion. The reciprocating travel of the wheel 60 is also conveyed to the bracket 64 with the result that the flange 72 on the end 70 of the bracket 64 may give the toy apparatus 10 the appearance of a wagging tail.

Still referring to FIG. 3, an optional second wheel 80 may be provided that is driven by the drive bar 56 and that may also be offset between 1 and 45 degrees from vertical. This other wheel 80 may be rotatably secured to the frame 12 by an axle 82 that is mounted at one end 84 to one sidewall 42 and has an opposite end 86 positioned in a slot (not shown) in the opposing sidewall 40. The second wheel 80 may then be biased into engagement with the drive bar 56 by a spring 88 that may be positioned on the opposing sidewall 40 proximate the opposite end 86 of the axle. Also, as mentioned supra, spacers 90 may be positioned on the axle 82 to assist in maintaining the axle 82 and the wheel 80 in their proper predetermined positions.

Referring again to FIGS. 2-7, the sensor(s) and/or switches 30, 32 may include one or more of a photo sensor; a pressure, touch or contact sensor; an audio sensor; or any combination of these sensors or switches. For example, as shown in FIGS. 4-7, a pin or switch 92 mounted for reciprocal movement with a housing 94 may be positioned proximate a "front" 34 of the apparatus 10. It may also be stylized in certain embodiments of the toy apparatus 10 to convey the appearance of the nose of an animal. As shown the pin 92 may be biased outwardly from the housing 94 by springs (not shown) and configured so that when the pin 92 contacts a surface an opposite end 96 of the pin 92 engages a sensor 98 that communicates electronically with the controller 26. Accordingly, in operation, forward movement of the toy apparatus 10 may cause it to impact a wall (not shown) or other surface and result in the pin 92 being forced inwardly to engage the sensor 98. The sensor 98 may then transmit a sign to the controller 26, which in turn may signal the motor 20 to cause the drive wheels 22 to reverse the direction of rotation for a predetermined period of time and maneuver the toy apparatus 10 away from the wall. It will also be appreciated that the controller 26, in addition to having the necessary drive control circuits, may also include any necessary memory, a speaker, and other logic circuits such that the toy 10 may perform an event (e.g., changing direction) or emit a sound in response to the activation of sensor 98, or another switch or sensor 32 positioned on the toy apparatus at a second location.

Still referring to FIGS. 2-7 in addition to the pin 92, it will also be appreciated that the sensor(s) or switch 30, 32 may include a photo sensor (not shown) that operates to guide the toy apparatus 10 toward or away from a light source or an audio sensor that operate to guide the toy apparatus 10 toward or away from an audio source. Moreover, the sensor(s) and or switch 30, 32 may be arranged to activate other functions of the toy apparatus 10 other than movement. For example, the controller 26 may operate to transmit a control signal to an audio emitting device on the circuit board 28 in response to a signal received from a sensor positioned on the front 34 or top 36 of the apparatus 10.

Still referring to FIGS. 2-7, and as best shown in FIG. 2, the sensor(s) and/or switches 30, 32 may also include a switch 100 positioned proximate the top 36 of the toy apparatus 10. This switch 100 may function to operate a servo-motor 102 that engages a housing 104 positioned proximate a front 34 of the apparatus 10. This housing 104 may include a plurality of plastic or electrometric filaments or "whiskers" 106 that may extend away from the apparatus 10. More specifically, the servo-motor 102 may be mechanically connected to ends (not shown) of the "whiskers" 106 that are positioned within the housing 104 and function to rapidly move or vibrate following activation of the switch 100.

Figure 8:
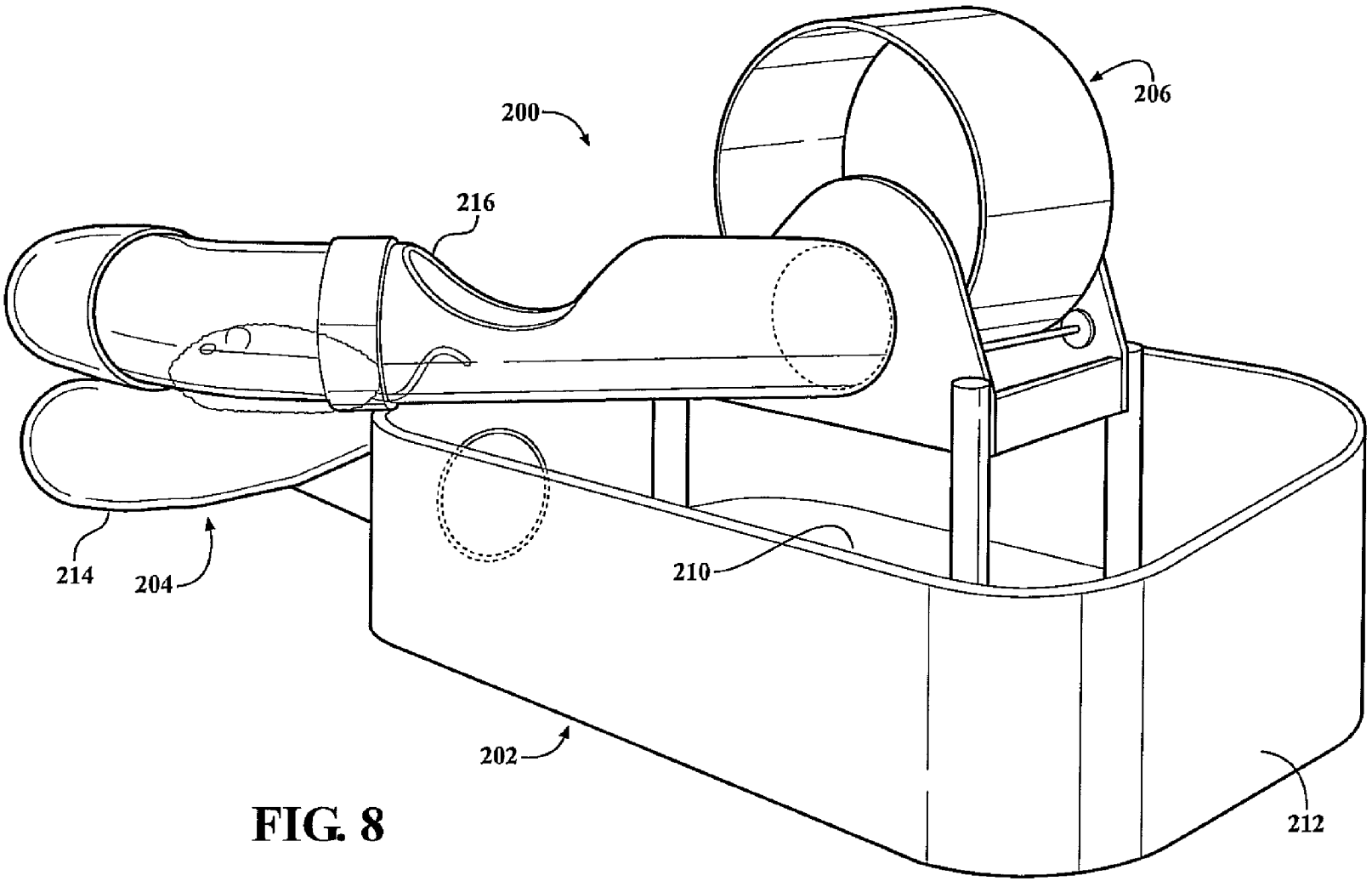
FIG. 8 is a perspective view of an environment for the toy apparatus including a ramp and a wheel.
Figure 9:
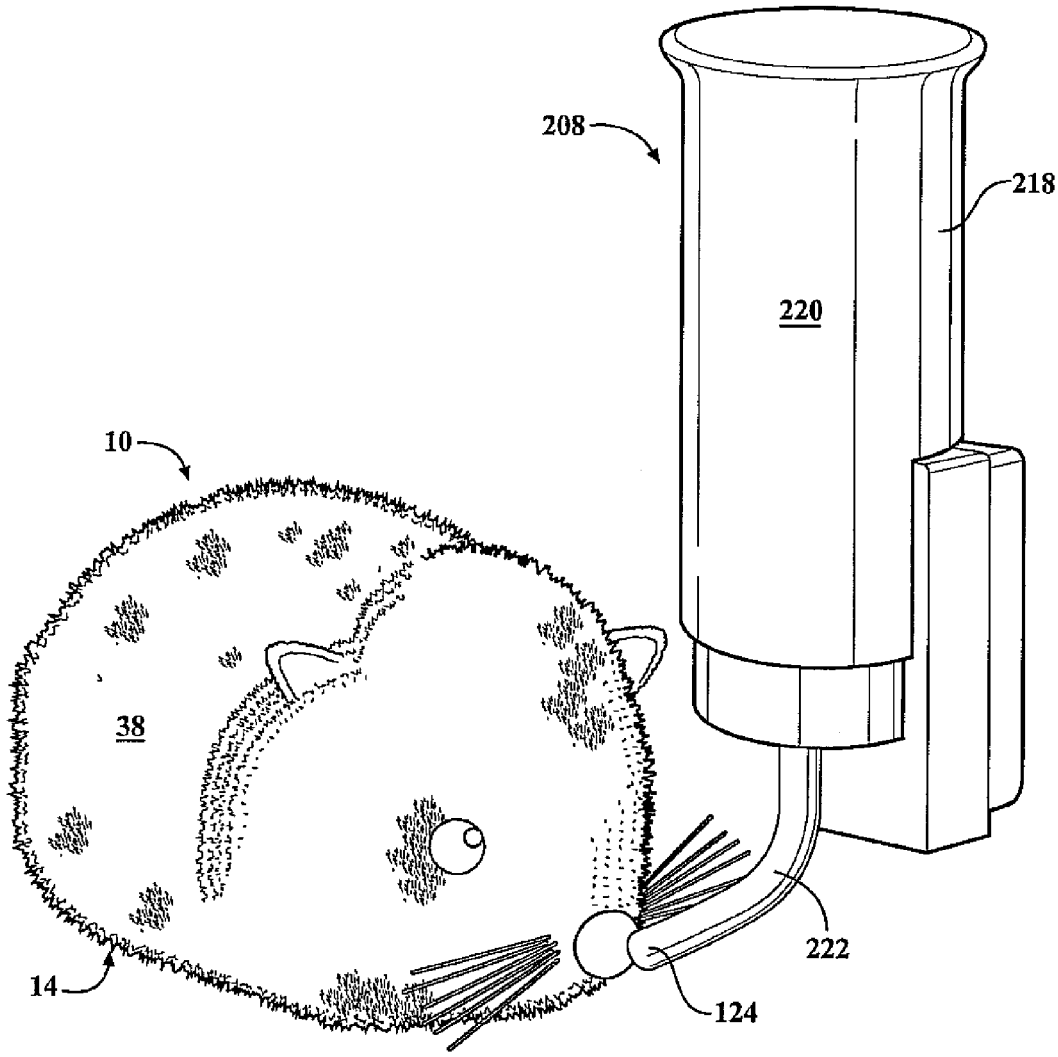
FIG. 9 is a perspective view of an environment for the toy apparatus showing a bottle device.

Referring now to FIGS. 1-9, and as best shown in FIGS. 8 and 9, environments 200 for the toy apparatus 10 may also be provided that include one or more platforms or enclosures 202, tubes, ramp(s) or guide member(s) 204, "exercise" wheel(s) 206 and other light or sound devices 208. As shown in FIG. 8, a platform or enclosure 202 may be formed from a transparent plastic or like material and include a floor 210 and one or more walls 212 that may extend around a perimeter of the enclosure 202. A tube or ramp 204 may also be provided that, in the case of a ramp, extends upwardly to a second platform or enclosure 202 or, as shown, an "exercise" wheel 206. The ramps or tubes 204 may include a flat base or floor 214 and an arched wall(s) 216 that extends from the base 214 to enclose (or partially enclose) the structure. The wheel 206 may be constructed similar to those commercially available for live pet rodents. Additionally, or alternatively, the tube or ramp 204 may be used to interconnection on enclosure 202 with a second enclosure 202 that is spaced above or horizontally away from the first enclosure 102. Accordingly, it will be appreciated that where the toy apparatus 10 may have the appearance of a hamster (or similar small pet) and the environment(s) 100 may be shaped and configured to give the appearance of a HABITRAIL®—or like small pet housing network—complete with an exercise wheel dimensioned to receive the toy 10 or even an enclosed "hamster ball" similar to those that are commercially available for allowing a pet rodent to exercise outside of its cage.

Referring now to FIG. 9, the light or sound devices 208 may include features such as a mock water bottle device 218 having a container portion 220 and a spout portion 222. An end 124 of the spout 122 may include a sensor or transmitter 124 (not shown). This sensor or transmitter 124 may in turn communicate with the controller 26 of the toy apparatus 10 or a separate controller (not shown) resident in the container portion 220 to cause the device 218 to emit at least one of a light or sound signal in response to the toy apparatus 10 contacting the sensor or transmitter 224.

Having thus described the embodiment of the invention various other embodiments will become apparent to those of skill in the art that do not depart from the scope of the present invention.

The invention claimed is:

1. A toy system comprising:

a toy apparatus including a frame and a shell, the shell extending over and around the frame, and the frame supporting a power source, a motor, at least three wheels, a controller, a first sensor, a second sensor and an audio emitting device, at least one of the wheels being mechanically connected to and driven by the motor, the first sensor being positioned on the frame and proximate a top of the apparatus and the second sensor being positioned on an end of the frame, the controller transmitting a control signal to the audio emitting device in response to a signal received from the first sensor and transmitting a control signal to the motor in response to a signal from the second sensor; and a first environment for the toy apparatus including a floor, a wall and having an open top the wall extending around a portion of a perimeter of the floor and defining an opening in the environment dimensioned to allow passage of the toy apparatus, and the floor having a generally continuous planer surface whereby the toy apparatus can travel across the environment between opposing portions of the floor.

2. The toy system of claim 1, comprising a second environment for the toy apparatus vertically spaced from the first environment, the first and second environments being connected by a guide configured to be traveled by the toy apparatus.

3. The toy system of claim 1, comprising a second environment for the toy apparatus spaced from the first environment, the first and second environments being connected by a guide member configured to be traveled by the toy apparatus.

4. The toy system of claim 1, wherein the first environment comprises an exercise wheel apparatus dimensioned to receive the toy apparatus.

5. The toy system of claim 1, wherein the first environment comprises a mock water bottle device having a container portion and a spout portion.

6. The toy system of claim 5, wherein the mock water bottle device of comprises at least one of a sensor or a transmitter.

7. A toy apparatus comprising:

a frame and a shell extending over and around the frame, the frame supporting a power source, a motor, a sensor, a controller and a drive wheel, the motor being powered by the power source, an axle for the drive wheel being mounted to the frame, with the drive wheel being configured to be driven by the motor and angled between 1 and 45 degrees to the longitudinal axis of the axle the sensor being positioned on an end of the frame and the controller operating to transmit a control signal to the motor in response to a signal from the sensor.

8. The toy apparatus of claim 7, further comprising a wheel assembly including a bracket mounted at one end by a hinge to the frame, a slot defined in the frame opposite the bracket, and the driven wheel, the driven wheel being mounted to an axle that is mounted to the bracket and that extends from the bracket into the slot.

9. The toy apparatus of claim 8, further comprising a second driven wheel positioned in tandem with the driven wheel, the second driven wheel and being offset between 1 and 45 degrees from vertical.

10. The toy apparatus of claim 8, wherein the driven wheel is positioned proximate a rear portion of the frame, and further comprising a pair of support wheels positioned proximate a front portion of the frame.

11. The toy apparatus of claim 8, wherein the bracket frame further comprises at an opposite end a flange that extends away from the frame.

12. The toy apparatus of claim 7, further comprising a plurality of filaments projecting from the frame, the motor being mechanically connected to the filaments, and including a switch operable to activate the motor, whereby activation of the motor by the switch causes movement of the filaments.

13. A toy apparatus comprising:

a frame and a shell extending over and around the frame, the frame supporting a power source, a motor powered by the power source and at least two wheels, and least one of the wheels being configured to be driven by the motor, and at least one of the wheels being mounted to an axle mounted to the frame, said wheel mounted to the axle angled between 1 and 45 degrees relative to the longitudinal axis of the axle.

14. The toy apparatus of claim 13, comprising three wheels and the at least one wheel configured to be driven by the motor being positioned proximate a rear portion of the frame.

15. The toy apparatus of claim 14, wherein the at least one wheel configured to be driven by the motor and the at least one wheel mounted to the axle are the same wheel.

16. The toy apparatus of claim 13, further comprising a plurality of filaments projecting from the frame, the motor being mechanically connected to the filaments and including a switch operable to activate the motor, whereby activation of the motor by the switch causes movement of the filaments.

17. The toy apparatus of claim 13, further comprising a sensor and a controller, the sensor being positioned on an end of the frame and the controller operating to transmit a control signal to the motor in response to a signal from the sensor.

18. The toy apparatus of claim 13, wherein the least one driven wheel and the at least one offset wheel are positioned in tandem on the frame.

* * * * *

UNITED STATES PATENT AND TRADEMARK OFFICE

CERTIFICATE OF CORRECTION

PATENT NO. : 8,066,544 B2
APPLICATION NO. : 12/756511
DATED : November 29, 2011
INVENTOR(S) : Clemens V. Hedeen, Jr.

It is certified that error appears in the above-identified patent and that said Letters Patent is hereby corrected as shown below:

At column 2, line number 26, delete “ends of)”, insert --ends) of--.

At column 2, line number 67, after alignment, insert --of--.

At column 4, line number 21, delete “operate”, insert --operates--.

At column 4, line number 57, delete “interconnection”, insert --interconnect--.

At column 5, line number 1, delete “devices”, insert --device--.

At column 5, line number 31, after top, insert --,--.

In the Claims:
At column 5, line number 54, after device, delete “of”.

At column 6, line number 4, after degrees, insert --relative--.

At column 6, line number 4, after axle, insert --,--.

At column 6, line number 16, after wheel, delete “and”.

At column 6, line number 33, after and, insert --at--.

At column 6, line number 47, after filaments, insert --,--.

Signed and Sealed this
Twenty-fifth Day of September, 2012

David J. Kappos

David J. Kappos
*Director of the United States Patent and Trademark Office*